US011626075B2

(12) United States Patent
Yang et al.

(10) Patent No.: US 11,626,075 B2
(45) Date of Patent: Apr. 11, 2023

(54) SCAN DRIVING UNIT

(71) Applicants: SAMSUNG DISPLAY CO., LTD., Yongin-si (KR); KONKUK UNIVERSITY INDUSTRIAL COOPERATION CORP, Seoul (KR)

(72) Inventors: Tae Hoon Yang, Yongin-si (KR); Joon Ho Lee, Seongnam-si (KR); Kee Chan Park, Seoul (KR); Ki Bum Kim, Yongin-si (KR); Jong Chan Lee, Yongin-si (KR); Woong Hee Jeong, Yongin-si (KR)

(73) Assignees: SAMSUNG DISPLAY CO, LTD., Gyeonggi-Do (KR); KONKUK UNIVERSITY INDUSTRIAL COOPERATION CORP, Seoul (KR)

( * ) Notice: Subject to any disclaimer, the term of this patent is extended or adjusted under 35 U.S.C. 154(b) by 0 days.

(21) Appl. No.: 17/296,001

(22) PCT Filed: Sep. 26, 2019

(86) PCT No.: PCT/KR2019/012533

§ 371 (c)(1),
(2) Date: May 21, 2021

(87) PCT Pub. No.: WO2020/105860

PCT Pub. Date: May 28, 2020

(65) Prior Publication Data

US 2022/0020332 A1 Jan. 20, 2022

(30) Foreign Application Priority Data

Nov. 23, 2018 (KR) ..... 10-2018-0146277

(51) Int. Cl.
*G09G 3/3266* (2016.01)
*G09G 3/3233* (2016.01)

(52) U.S. Cl.
CPC ..... *G09G 3/3266* (2013.01); *G09G 3/3233* (2013.01); *G09G 2300/0426* (2013.01);
(Continued)

(58) Field of Classification Search
CPC ..... G09G 3/3266; G09G 3/3233; G09G 2300/0426; G09G 2300/0842; G09G 2310/08; G09G 2320/0223
See application file for complete search history.

(56) References Cited

U.S. PATENT DOCUMENTS 7,283,117 B2 10/2007 Noda
9,786,240 B2 10/2017 Zhao et al.
(Continued)

FOREIGN PATENT DOCUMENTS

JP 3589926 B2 11/2004
KR 1020130129124 A 11/2013
(Continued)

OTHER PUBLICATIONS

International Search Report dated Jan. 6, 2020 for PCT/KR2019/012533.

*Primary Examiner* — Stacy Khoo

(57) ABSTRACT

A scan driver includes stage circuits, wherein each of the stage circuits includes a first transistor, wherein a first electrode thereof is coupled to a first node, a second electrode thereof is coupled to an input carry line, and a gate electrode thereof is coupled to a first clock line; and a capacitor, wherein a first electrode thereof is coupled to the first node and a second electrode thereof is coupled to a second node, wherein the second node is coupled to an output carry line, and the second node is selectively coupled to one of a first power voltage line and a second power voltage line.

10 Claims, 12 Drawing Sheets

(52) U.S. Cl.
CPC ..... *G09G 2300/0842* (2013.01); *G09G 2310/08* (2013.01); *G09G 2320/0223* (2013.01)

(56) References Cited

U.S. PATENT DOCUMENTS

| | | | |
|---|---|---|---|
| 10,096,286 | B2 | 10/2018 | Cho et al. |
| 10,573,225 | B2 | 2/2020 | Lee et al. |
| 10,755,622 | B2 | 8/2020 | Kong et al. |
| 10,783,832 | B2 | 9/2020 | Shin et al. |
| 2001/0011987 | A1 | 8/2001 | Kubota et al. |
| 2016/0210920 | A1 | 7/2016 | Kim et al. |
| 2016/0225462 | A1 | 8/2016 | Harada |

FOREIGN PATENT DOCUMENTS

| | | | |
|---|---|---|---|
| KR | 1020170087086 | A | 7/2017 |
| KR | 1020180021358 | A | 3/2018 |
| KR | 1020180036893 | A | 4/2018 |
| KR | 1020180081196 | A | 7/2018 |

SCAN DRIVING UNIT

This application is a National Phase of International Application No. PCT/KR2019/012533 filed on Sep. 26, 2019, which is claims priority of Korean Patent Application No. 10-2018-0146277 filed on Nov. 23, 2018, which is hereby incorporated herein by reference in its entirety for all purposes.

TECHNICAL FIELD

Various embodiments of the disclosure relate to a scan driver.

BACKGROUND ART

With the development of information technology, the importance of a display device that is a connection medium between a user and information has been emphasized. Owing to the importance of the display device, the use of various display devices, such as a liquid crystal display (LCD) device, an organic light-emitting display device, and a plasma display device, has increased.

A display device writes a data voltage corresponding to each pixel, and allows each pixel to emit light. Each pixel emits light with luminance corresponding to a written data voltage. A displayed image may be represented by a combination of light emission of these pixels.

A scan driver includes a plurality of stage circuits, each of which generates a scan signal for determining a pixel to which a data voltage is to be written. Since respective scan signals are transferred to a plurality of pixels, the scan signals may have a resistance-capacitance CRC") delay larger than that of other signals, Therefore, when driving ability of each stage circuit is insufficient, an overlap between scan signals may occur, and thus an erroneous data voltage may be written to pixels.

DISCLOSURE

Technical Problem

Various embodiments of the disclosure are directed to a scan driver in which stage circuits are implemented as complementary metal oxide semiconductor ("CMOS") circuits to have improved driving ability.

Technical Solution

A scan driver according to an embodiment of the disclosure may include stage circuits, where each of the stage circuits may include a first transistor, where a first electrode thereof is coupled to a first node, a second electrode thereof is coupled to an input carry line, and a date electrode thereof is coupled to a first clock line; and a capacitor, where a first electrode thereof is coupled to the first node and a second electrode thereof is coupled to a second node, where the second node is coupled to an output carry line, and the second node is selectively coupled to one of a first power voltage line and a second power voltage line.

In an embodiment, the scan driver may further include a second transistor, where a first electrode thereof is coupled to the second node, a second electrode thereof is coupled to the second power voltage line, and a gate electrode s thereof is coupled to a second clock line.

In an embodiment, the scan driver may further include a third transistor, where a first electrode thereof is coupled to the first power voltage line, a second electrode thereof is coupled to the second node, and a gate electrode thereof is coupled to a third node.

In an embodiment, the scan driver may further include a fourth transistor, where a first electrode thereof is coupled to the second node, a second electrode thereof is coupled to the second power voltage line, and a gate electrode thereof is coupled to the third node.

In an embodiment, the scan driver may further include a fifth transistor, where a first electrode thereof is coupled to the first power voltage line, a second electrode thereof is coupled to the third node, and a gate electrode thereof is coupled to the first node.

In an embodiment, the scan driver may further include a sixth transistor, where a first electrode thereof is coupled to the third node, a second electrode thereof is coupled to the second dock line, and a gate electrode thereof is coupled to the first node.

In an embodiment, the first transistor, the third transistor, and the fifth transistor may be P-type transistors, and the second transistor, the fourth transistor, and the sixth transistor may be N-type transistors.

In an embodiment, the scan driver may further include a first inverter, where an input terminal thereof is coupled to the second node and an output terminal thereof is coupled to a scan line.

In an embodiment, the scan driver may further include a second inverter, where an input terminal thereof is coupled to the scan line and an output terminal thereof is coupled to an inverted scan line.

In an embodiment, pulses of a first clock signal applied to the first clock line may not temporally overlap pulses of a second clock signal applied to the second clock line.

Advantageous Effects

The scan driver according to embodiments of the disclosure has improved driving ability by implementing stage circuits as CMOS circuits.

MODE FOR INVENTION

Figure 1:
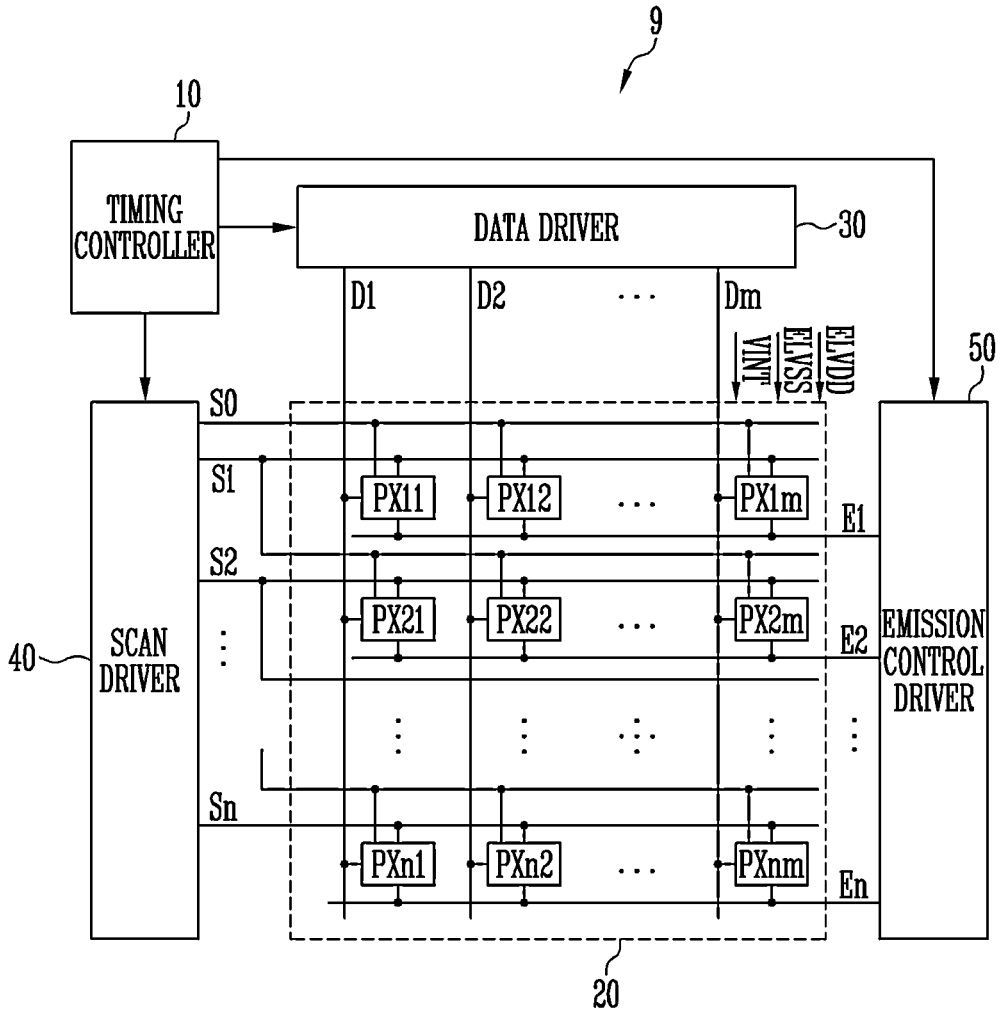
FIG. 1 is a diagram illustrating a display device according to an embodiment of the disclosure.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art.

Furthermore, in the drawings, portions which are not related to the disclosure will be omitted to explain the disclosure more dearly. Reference should be made to the drawings, in which similar reference numerals are used throughout the different drawings to designate similar components. Therefore, reference numerals described in a previous drawing may be used in other drawings.

Further, since the sizes and thicknesses of respective components are arbitrarily indicated in drawings for convenience of description, the disclosure is not limited by the drawings. The sizes, thicknesses, etc. of components in the drawings may be exaggerated to make the description of a plurality of various layers and areas clear.

It will be understood that, although the terms "first," "second," "third" etc. may be used herein to describe various elements, components, regions, layers and/or sections, these elements, components, regions, layers and/or sections should not be limited by these terms. These terms are only used to distinguish one s element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an." "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

FIG. 1 is a diagram illustrating a display device according to an embodiment of the disclosure, Referring to FIG. 1, a display device 9 according to an embodiment of the disclosure includes a timing controller 10, a pixel component 20, a data driver 30, a scan driver 40, and an emission control driver 50.

The timing controller 10 converts control signals and image signals, which are supplied from a processor (e.g., an application processor), in conformity with the specification of the display device 9, and supplies a control signal and image signals to the data driver 30, the scan driver 40, and the emission control driver 50.

The pixel component 20 may include pixels PX11, PX12, . . . , PX1*m*, PX21, PX22, . . . , PX2*m*, . . . , PXn1, PXn2, . . . , PXnm. Each of the pixels may be coupled to a data line and a scan line corresponding thereto. Each pixel may receive a data voltage from a corresponding data line in response to a scan signal received from a corresponding scan line. Each pixel may emit light with luminance corresponding to the data voltage in response to an emission control signal received from a corresponding emission control line. Each pixel may be couple to a first driving voltage line EVLDD, a second driving voltage line ELVSS, and an initialization voltage line VINT, and may then be supplied with voltages for driving therethrough.

The data driver 30 may receive the control signals and the image signals from the timing controller 10, and may then generate data voltages to be supplied to data lines D1, D2, . . . , Dm. The data voltages generated on a pixel row basis may be simultaneously applied to the data lines D1, D2, . . . , Dm.

The scan driver 40 receives the control signals from the timing controller 10 and then generates scan signals to be supplied to the scan lines S0, S1, S2, . . . , Sn. The scan driver 40 according to an embodiment will be described in detail later with reference to FIG. 2.

The emission control driver 50 may supply emission control signals for determining emission periods of the pixels PX11, PX12, . . . , PX1*m*, PX21, PX22, . . . , PX2*m*, . . . , PXn1, PXn2, . . . , PXnm through emission control lines E1, E2, . . . , En. In one embodiment, for example, each pixel may include an emission control transistor, and whether current is to flow into an organic light-emitting diode is determined depending on the on/off operation of the emission control transistor, and thus emission control may be performed. In accordance with an embodiment, the emission control driver 50 may be configured in a sequential emission type in which individual pixel rows are controlled to sequentially emit light. In an alternative to embodiment, the emission control driver 50 may be configured in a simultaneous emission type in which all pixel rows are controlled to simultaneously emit light.

Figure 2:
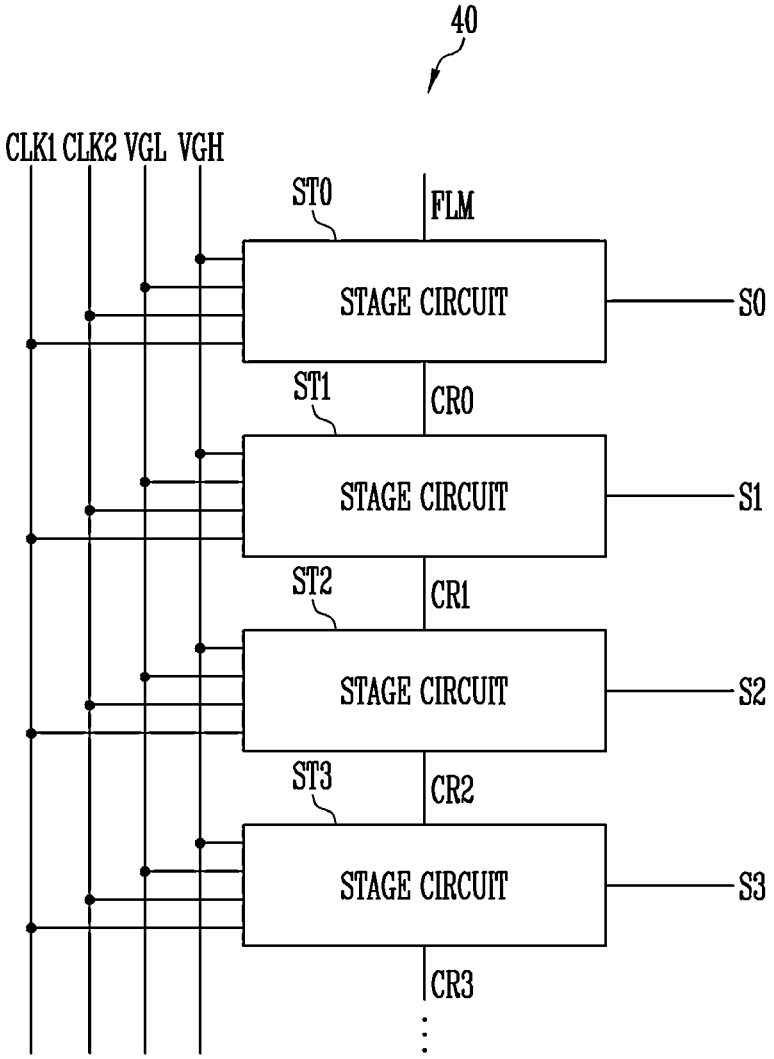
FIG. 2 is a diagram illustrating a scan driver according to an embodiment of the disclosure.

FIG. 2 is a diagram illustrating a scan driver according to an embodiment of the disclosure.

Referring to FIG. 2, the scan driver 40 according to an embodiment includes stage circuits ST0, ST1, ST2, ST3, . . . .

Respective stage circuits are coupled to a first clock line CLK1, a second clock line CLK2, a first power voltage line VGH, a second power voltage line VGL, corresponding carry lines CR0, CR1, CR2, CR3, . . . , and corresponding scan lines S0, S1, S2, S3, . . . . In such an embodiment, the first stage circuit ST0 is coupled to a start signal line FLM instead of an input carry line.

A high voltage is applied to the first power voltage line VGH, and a voltage lower than that of the first power voltage line VGH is applied to the second power voltage line VGL. A first clock signal in which pulses are generated at a first period may be applied to the first clock line CLK1. A second clock signal in which pulses are generated at a second period may be applied to the second clock line CLK2. The pulses may be falling pulses having a low level. The first period and the second period may be equal to each other. Here, the pulses of the first dock signal and the pulses of the second clock signal may not temporally overlap each other.

When a start pulse is applied through the start signal line FLM coupled to the first stage circuit ST0, the stage circuit ST0 outputs a carry signal generated by an internal operation thereof to the carry line CR0, and outputs a scan signal to the scan line S0.

When the carry signal is applied through the carry line CR0 coupled to the next stage circuit ST1, the stage circuit ST1 outputs a carry signal generated by the internal operation thereof to the carry line CR1, and outputs a scan signal to the scan line S1.

This operation is repeatedly performed by the next stages circuits ST2, ST3 . . . .

Since the stage circuits ST0, ST1, ST2, ST3, . . . have substantially the same internal structure as each other, for convenience of description, an arbitrary i-th stage circuit will hereinafter be described in detail with reference to FIG. 3.

Figure 3:
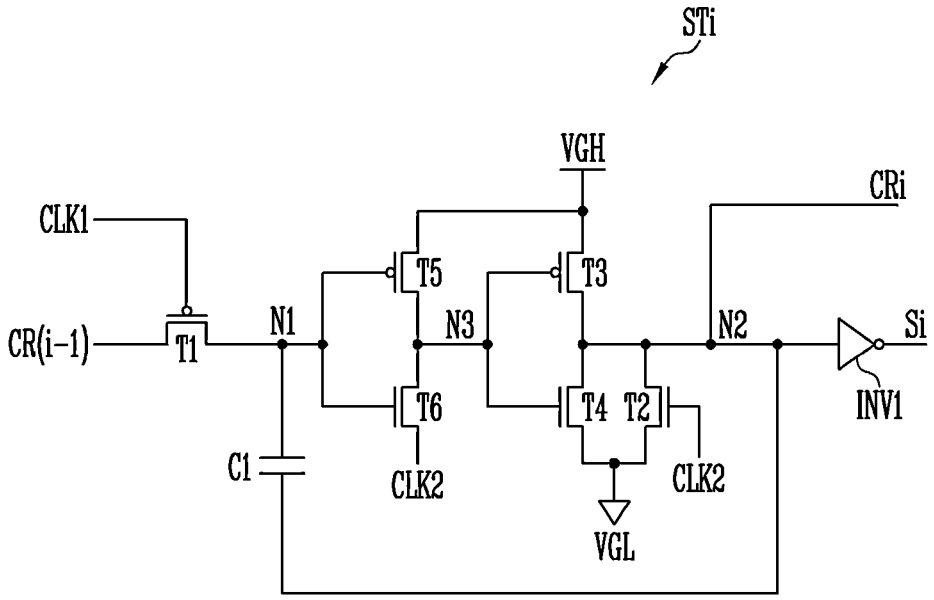
FIG. 3 is a diagram illustrating a stage circuit according to an embodiment of the disclosure.

FIG. 3 is a diagram illustrating a stage circuit according to an embodiment of the disclosure.

Referring to FIG. 3, an embodiment of a stage circuit STi may include transistors T1, T2, T3, T4, T5, and T6, a capacitor C1, and an inverter INV1.

The first transistor T1 may be coupled at a first electrode thereof to a first node N1, coupled at a second electrode thereof to an input carry line CR(i−1), and coupled at a gate electrode thereof to a first clock line CLK1.

The capacitor C1 may be coupled at a first electrode thereof to the first node N1 and coupled at a second electrode thereof to a second node N2.

The second node N2 may be coupled to an output carry line CRL. The second node N2 may be selectively or alternately coupled to one of a first power voltage line VGH and a second power voltage line VGL.

The second transistor T2 may be coupled at a first electrode thereof to the second node N2, coupled at a second electrode thereof to the second power voltage line VGL, and coupled at a gate electrode thereof to a second clock line CLK2.

The third transistor T3 may be coupled at a first electrode thereof to the first power voltage line VGH, coupled at a second electrode thereof to the second node N2, and coupled at a gate electrode thereof to a third node N3.

The fourth transistor T4 may be coupled at a first electrode thereof to the second node N2, coupled at a second electrode thereof to the second power voltage line VGL, and coupled at a gate electrode thereof to the third node N3.

The fifth transistor T5 may be coupled at a first electrode thereof to the first power voltage line VGH, coupled at a second electrode thereof to the third node N3, and coupled at a gate electrode thereof to the first node N1.

The sixth transistor T6 may be coupled at a first electrode thereof to the third node N3, coupled at a second electrode thereof to the second clock line CLK2, and coupled at a gate electrode thereof to the first node N1.

The first inverter INV1 may be coupled at an input terminal thereof to the second node N2 and coupled at an output terminal thereof to the scan line Si.

The first transistor T1, the third transistor T3, and the fifth transistor T5 may be P-type transistors, and the second transistor T2, the fourth transistor T4, and the sixth transistor T6 may be N-type transistors.

The term "P-type transistor" commonly designates a transistor through which an increased amount of current flows when a voltage difference between a gate electrode and a source electrode increases in a negative direction. The term "N-type transistor" commonly designates a transistor through which an increased amount of current flows when a voltage difference between a gate electrode and a source electrode increases in a positive direction. Each transistor may be implemented as any of various types of transistors, such as a thin film transistor (TFT), a field effect transistor (FET), and a bipolar junction transistor (BIT).

In accordance with an embodiment, the third transistor T3 and the fourth transistor T4 may be implemented in a complementary metal oxide semiconductor ("CMOS") type, the fifth transistor T5 and the sixth transistor T6 may be implemented in a CMOS type, and the first inverter INV1 may be implemented in a CMOS type. In such an embodiment, the P-type transistors T3, T5, . . . in the CMOS type take charge of and perform a pull-up function, and the N-type transistors T4, T6, . . . in the CMOS type take charge of and perform a pull-down function, and thus current driving ability is improved when compared with a conventional stage circuit composed of only P-type transistors or only N-type transistors. In such an embodiment, since the channel width of a buffer transistor may be reduced, a circuit area and power consumption may be allowed to be decreased.

Figure 4:
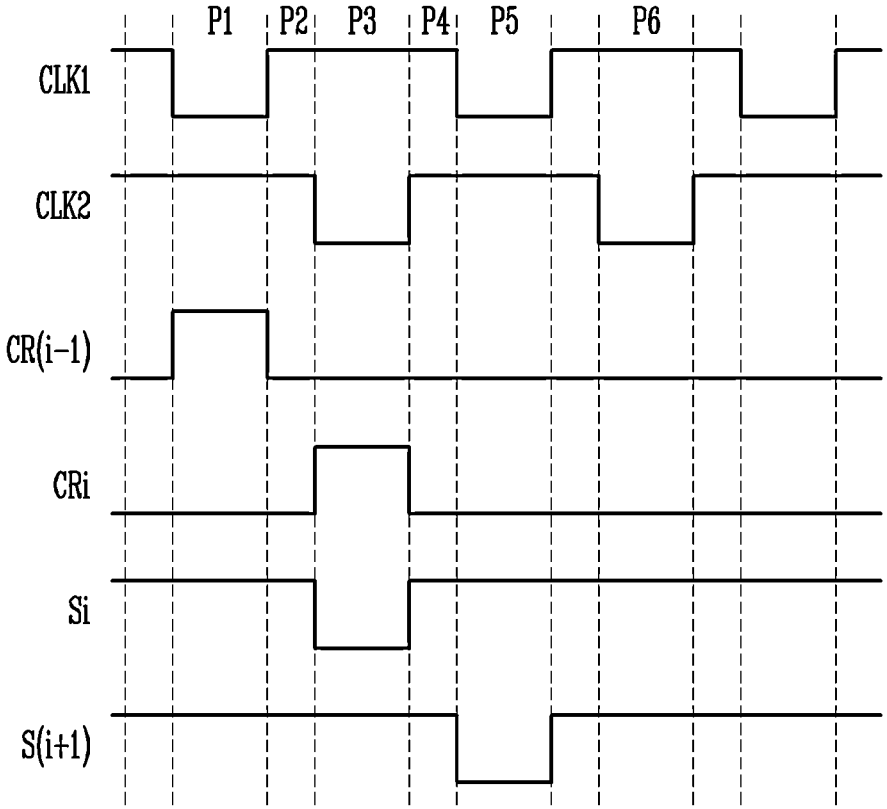
FIG. 4 is a diagram illustrating a method of driving the stage circuit of FIG. 3.

FIG. 4 is a diagram illustrating a method of driving the stage circuit of FIG. 3.

Referring to FIG. 4, a first clock signal applied to a first clock signal line CLK1, a second clock signal applied to a second clock signal line CLK2, an input carry signal applied to an input carry line CR(i−1), an output carry signal output from an output carry line CRi, and a scan signal applied to a scan line Si are illustrated. A next scan signal applied to a next scan line S(i+1) is illustrated for timing comparison.

During a first period P1, the first clock signal is at a low level and the second dock signal is at a high level. That is, a falling pulse is generated in the first dock signal During the first period P1, the input carry signal is at a high level.

Therefore, the first transistor T1 is turned on in response to the first clock signal, and the first node N1 is charged to a high level in response to the input carry signal. Also, since the second transistor T2 is turned on in response to the second clock signal and the second node N2 is coupled to the second power voltage line VGL, the second node N2 is charged to a low level.

Therefore, during the first period P1, the scan signal is maintained at a high level and the output carry signal is maintained at a low level.

During a second period P2, the first clock signal is transitioned to a high level, and thus the first transistor T1 is turned off. Here, the voltage of the first node N1 is held by the voltage stored in the capacitor C1 and the second power voltage line VGL, and is then maintained at a high level.

During a third period P3, the first clock signal is at a high level and the second clock signal is at a low level. That is, a falling pulse is generated in the second clock signal.

Currently, the sixth transistor T6 is in a turn-on state in response to the high-level voltage of the first node N1. Therefore, the second clock signal at a low level is applied to the third node N3, and thus the third transistor T3 is turned on. Through the turned-on third transistor T3, the first power voltage line VGH is coupled to the second node N2 and the second node N2 is charged to a high level.

Therefore, during the third period P3, the scan signal is transitioned to a low level and the output carry signal is transitioned to a high level. That is, a falling pulse is generated in the scan signal and a rising pulse is generated in the output carry signal.

During a fourth period P4, the second clock signal is transitioned to a high level, and thus the second transistor T2 is turned on and the second node N2 is coupled to the second power voltage line VGL. Therefore, the second node N2 is charged to a low level, and the voltage of the first node N1 is also transitioned to a low level due to coupling caused by the capacitor C1.

Therefore, during the fourth period P4, the scan signal is transitioned to a high level and the output carry signal is transitioned to a low level.

During a fifth period P5, the first dock signal is at a low level and the second dock signal is at a high level. That is, a falling pulse is generated in the first clock signal.

However, unlike in the first period P1, the input carry signal is at a low level during the fifth period P5. Therefore, the first node N1 is charged to a low level.

During a sixth period P6, the first clock signal is at a high level and the second clock signal is at a low level. That is, a falling pulse is generated in the second clock signal.

However, during the sixth period P6, unlike in the third period P3, the sixth transistor T6 is in a turn-off state in response to the low-level voltage of the first node N1. Therefore, the second clock signal at a low level may not be applied to the third node N3, and thus the third transistor T3 is maintained in a turn-off state. Therefore, the second node N2 that is not coupled to the first power voltage line VGH is maintained at a low level.

Therefore, during the period P6, the scan signal is maintained at a high level and the output carry signal is maintained at a low level.

Figure 5:
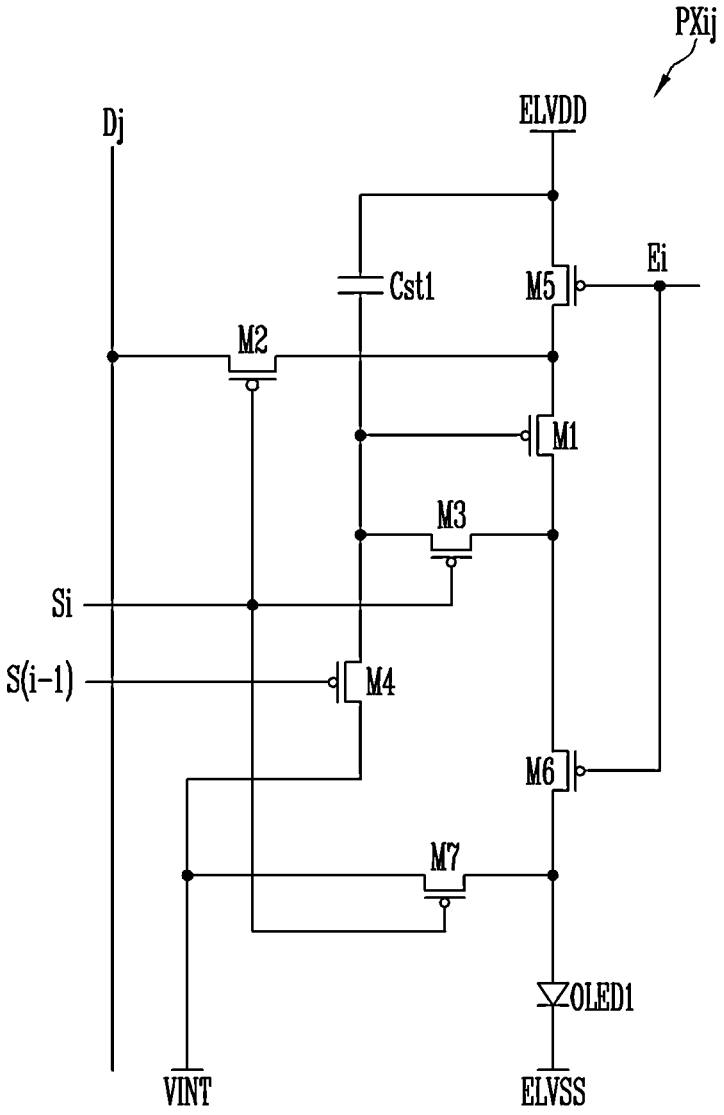
FIG. 5 is a diagram illustrating a pixel according to an embodiment of the disclosure.

FIG. 5 is a diagram illustrating a pixel according to an embodiment of the disclosure.

Referring to FIG. 5, an embodiment of a pixel PXij may include transistors M1, M2, M3, M4, M5, M6, and M7, a storage capacitor Cst1, and an organic light-emitting diode OLED1. The transistors M1 to M7 may be P-type transistors.

The storage capacitor Cst1 may be coupled at a first electrode thereof to a first driving voltage line ELVDD and coupled at a second electrode thereof to a gate electrode of the transistor M1.

The transistor M1 may be coupled at a first electrode thereof to a second electrode of the transistor M5, coupled at a second electrode thereof to a first electrode of the transistor M6, and coupled at the gate electrode thereof to the second electrode of the storage capacitor Cst1. The transistor M1 may be designated as a driving transistor. The transistor M1 determines the amount of driving current flowing between the first driving voltage line ELVDD and a second driving voltage line ELVSS depending on a potential difference between the gate electrode and the source electrode thereof.

The transistor M2 may be coupled at a first electrode thereof to a data line Dj, coupled at a second electrode thereof to the first electrode of the transistor M1, and coupled a gate electrode thereof to a scan line Si. The transistor M2 may be designated as a scan transistor. When a scan signal having a turn-on level is applied to the scan line Si, the transistor M2 inputs a data voltage of the data line Dj into the pixel PXij.

The transistor M3 is coupled at a first electrode thereof to the second electrode of the transistor M1, coupled at a second electrode thereof to the gate electrode of the transistor M1, and coupled at a gate electrode thereof to the scan line Si. When the scan signal having a turn-on level is applied to the scan line Si, the transistor M3 allows the transistor M1 to be coupled in a form of a diode.

The transistor M4 is coupled at a first electrode thereof to the gate electrode of the transistor M1, coupled at a second electrode thereof to an initialization voltage line VINT, and coupled at a gate electrode thereof to a scan line S(i−1). In alternative embodiments, the gate electrode of the transistor M4 may be coupled to another scan line. When the scan signal having a turn-on level is applied to the scan line S(i−1), the transistor M4 initializes the amount of charge in the gate electrode of the transistor M1 by transferring an initialization voltage VINT to the gate electrode of the transistor M1.

The transistor M5 is coupled at a first electrode thereof to the first driving voltage ELVDD, coupled at the second electrode thereof to the first electrode of the transistor M1, and coupled at a gate electrode thereof to an emission control line Ei. The transistor M6 is coupled at the first electrode thereof to the second electrode of the transistor M1, coupled at a second electrode thereof to an anode of the organic light-emitting diode OELD1, and coupled at a gate electrode thereof to the emission control line Ei. Each of the transistors M5 and M6 may be designated as an emission control transistor. When an emission control signal having a turn-on level is applied to the transistors M5 and M6, the transistors M5 and MG form a driving current path between the first driving voltage line ELVDD and the second driving voltage line ELVSS, thus allowing the organic light-emitting diode OELD1 to emit light.

The transistor M7 is coupled at a first electrode thereof to the anode of the organic light-emitting diode OLED1, coupled at a second electrode thereof to the initialization voltage line VINT, and coupled at a gate electrode thereof to the scan line Si. In alternative embodiments, the gate electrode of the transistor M7 may be coupled to another scan line. When a scan signal having a turn-on level is applied to the transistor M7, the transistor M7 initializes the amount of charge accumulated in the organic light-emitting diode OELD1 by transferring the initialization voltage to the anode of the organic light-emitting diode OLED1.

The organic light-emitting diode OLED1 may be coupled at the anode thereof to the second electrode of the transistor M6, and coupled at a cathode thereof to the second driving voltage line ELVSS.

Figure 6:
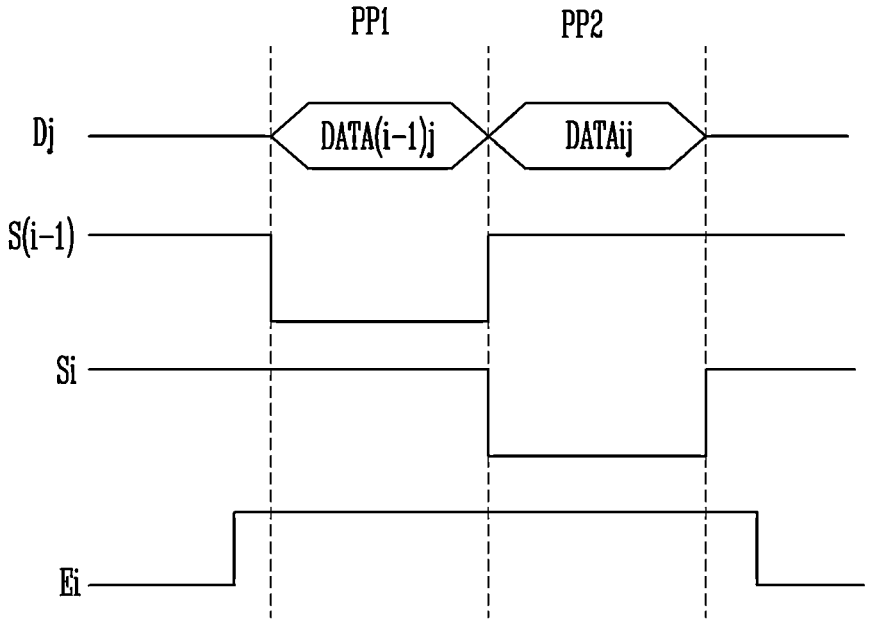
FIG. 6 is a diagram illustrating an embodiment of a method of driving the pixel of FIG. 5.

FIG. 6 is a diagram illustrating an embodiment of a method of driving the pixel of FIG. 5.

During a first period PP1, a data voltage DATA(i−1)j for a previous pixel row is applied to the data line Dj and a scan signal having a turn-on level (low level) is applied to the scan line S(i−1).

Since a scan signal having a turn-off level (a high level) is applied to the scan line Si, the transistor M2 is in a turn-off state, and the data voltage DATA(i−1)j for the previous pixel row is prevented from being input into the pixel PXij.

During the first period PP1, since the transistor M4 is in a turn-on state, the initialization voltage is applied to the gate electrode of the transistor M1, and thus the amount of charge is initialized. Since an emission control signal having a turn-off level is applied to the emission control line Ei, the transistors M5 and M6 are in a turn-off state, and unnecessary emission of the organic light-emitting diode OLED1 attributable to a procedure for applying the initialization voltage VINT is prevented.

During a second period PP2, a data voltage DATAij for a current pixel row is applied to the data line Dj, and a scan signal having a turn-on level is applied to the scan line Si. Therefore, the transistors M2, M1, and M3 are turned on, and thus the data line Dj and the gate electrode of the transistor M1 are electrically coupled to each other. Therefore, the data voltage DATAij is applied to the second electrode of the storage capacitor Cst1, and the storage capacitor Cst1 accumulates an amount of charge corresponding to the difference between the voltage of the first driving voltage line ELVDD and the data voltage DATAij.

During the second period PP2, since the transistor M7 is in a turn-on state, the initialization voltage VINT is applied to the anode of the organic light-emitting diode OLED1, and the organic light-emitting diode OELD1 is pre-charged or initialized to the amount of charge corresponding to the difference between the initialization voltage and the voltage of the second driving voltage line ELVSS.

As the emission control signal having a turn-on level is applied to the emission control line Ei after the second period PP2, the transistors M5 and M6 are turned on, and the amount of driving current passing through the transistor M1 is to adjusted depending on an amount of charge accumulated in the storage capacitor Cst1, and thus the driving current flows through the organic light-emitting diode OLED1. The organic light-emitting diode OLED1 emits light until an emission control signal having a turn-off level is applied to the emission control line Ei.

Figure 7:
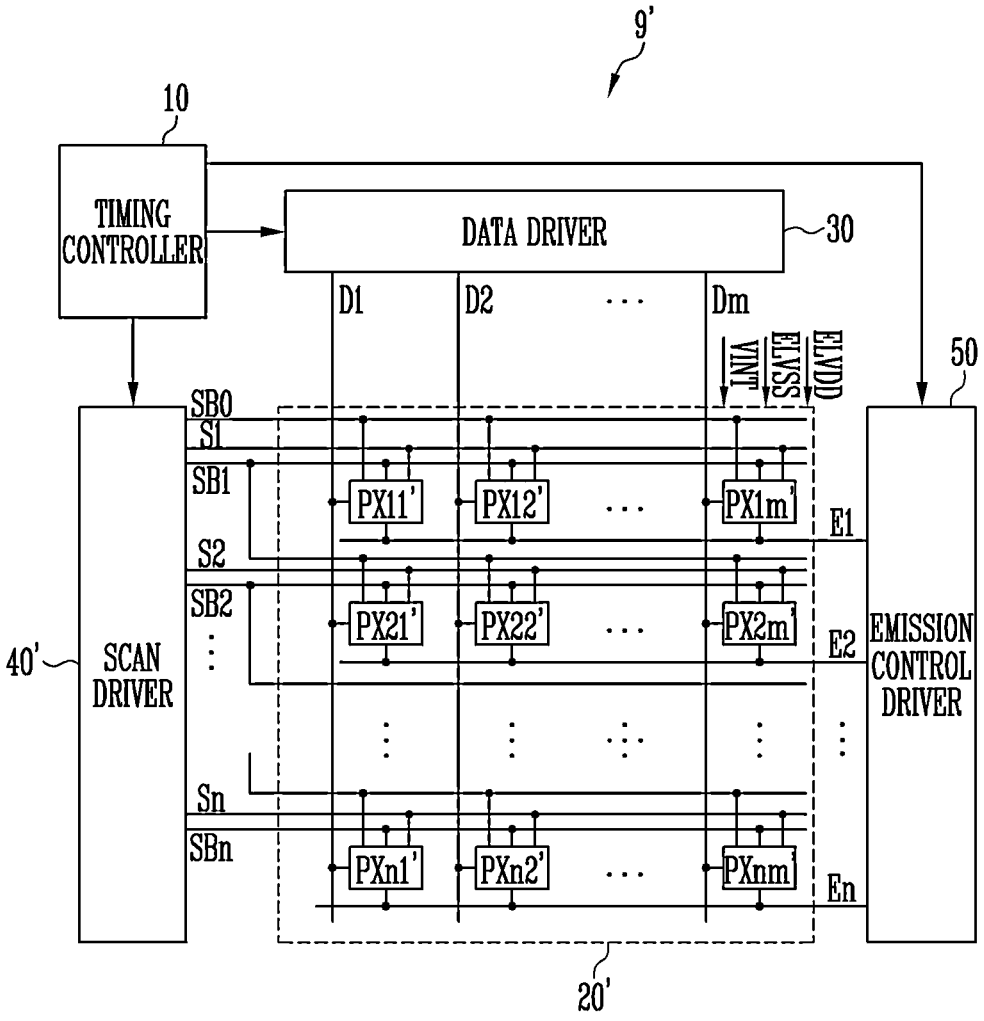
FIG. 7 is a diagram illustrating a display device according to an alternative embodiment of the disclosure.

FIG. 7 is a diagram illustrating a display device according to an alternative embodiment of the disclosure.

Referring to FIG. 7, a display device 9' according to an alternative embodiment of the disclosure includes a timing controller 10, a pixel component 20', a data driver 30, a scan driver 40', and an emission control driver 50.

The display device 9' shown in FIG. 7 is substantially the same as the display device 9 described above with reference to FIG. 1 except for the configuration of the pixel component 20' and the scan driver 40'. The same or like elements shown in FIG. 7 have been labeled with the same reference characters as used above to describe the embodiment of the display device 9 shown in FIG. 1, and any repetitive detailed description thereof will hereinafter be omitted or simplified.

The pixel component 20' may include pixels PX11', PX12', PX1*m*', PX21', PX22', . . . , PX2*m*', . . . , PXn1', PXn2', . . . , PXnm'. In each pixel row, the pixel component 20' and the scan driver 40' are coupled to each other through scan lines S1, S2, . . . , Sn and inverted scan lines SB0, SB1, . . . , SBn. Accordingly, the pixel structure of the pixel component 20' and the stage circuit structure of the scan driver 40' in an alternative embodiment will be described below with reference to FIG. 8 and subsequent drawings, FIG. 8 is a diagram illustrating a scan driver according to an alternative embodiment of the disclosure.

Figure 8:
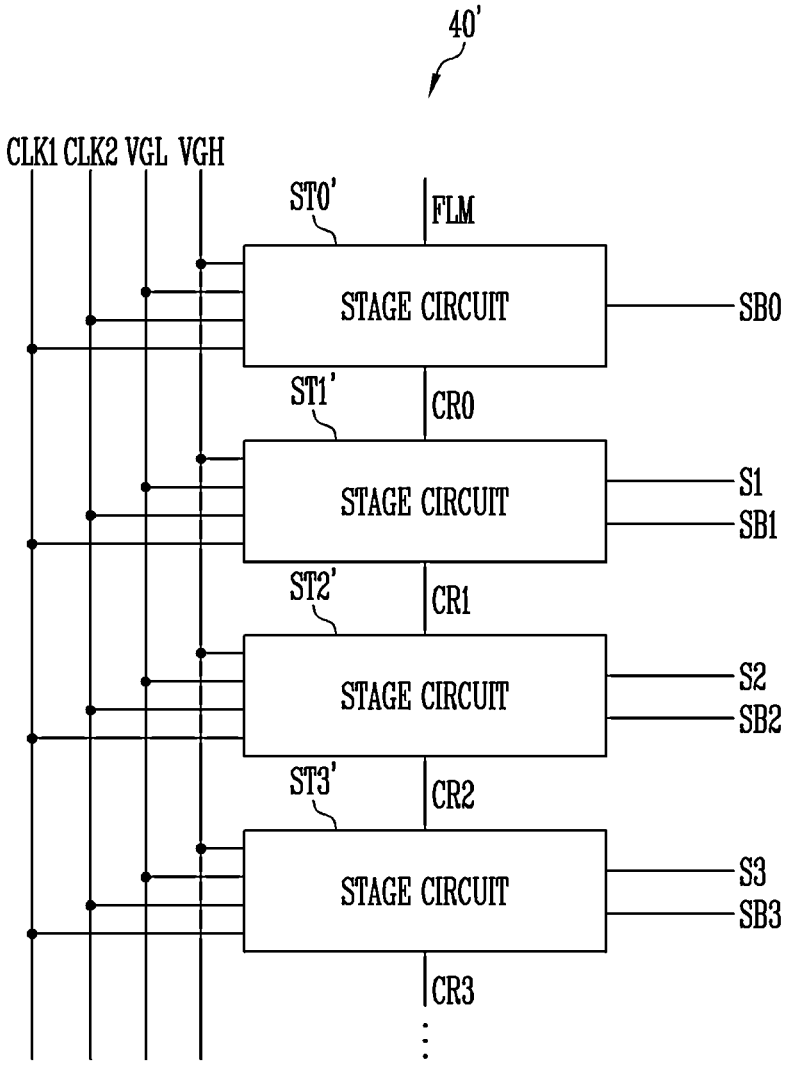
FIG. 8 is a diagram illustrating a scan driver according to an alternative embodiment of the disclosure.

Referring to FIG. 8, the scan driver 40' includes stage circuits ST0', ST1', ST2', ST3', . . . .

In such an embodiment, the scan driver 40' is the same as the scan driver 40 of FIG. 2 except that the scan driver 40' is further coupled to the inverted scan lines 580, SB1, SB2, SB3, . . . , and any repetitive detailed description of the same or like elements thereof will hereinafter be omitted or simplified.

Each stage of the scan driver 40' is provided with an inverted scan line, in addition to the corresponding scan line, as output lines. In accordance with an embodiment, the scan line of the first stage circuit ST0' may also be used only for generation of an inverted scan signal without extending to the pixel component 20'. The utilization of individual output lines may be configured differently depending on the signal required by each pixel.

Figure 9:
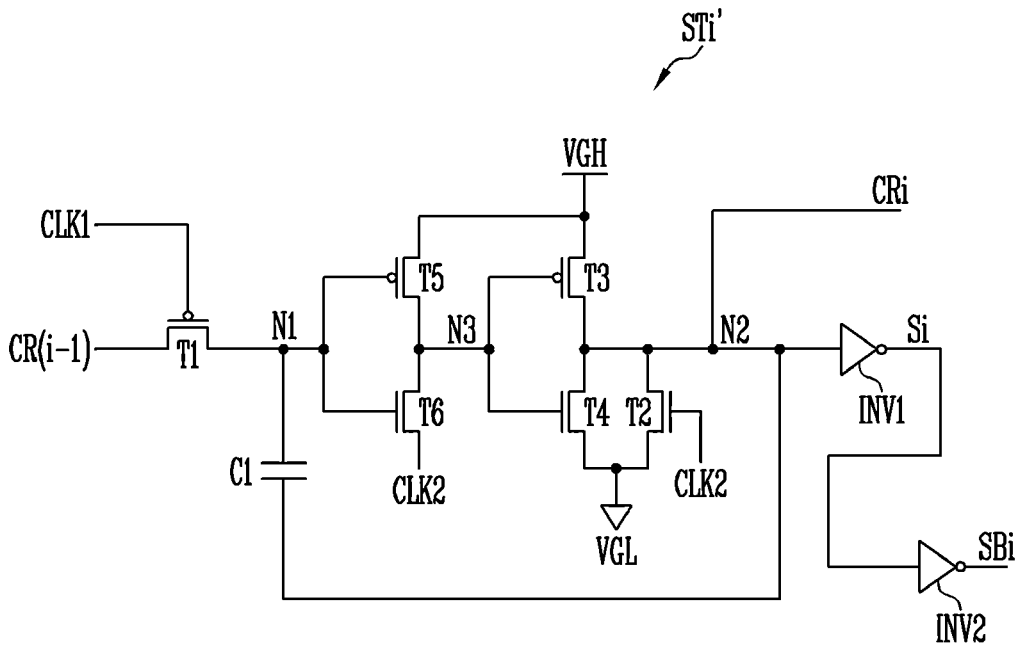
FIG. 9 is a diagram illustrating a stage circuit according to another alternative embodiment of the disclosure.

FIG. 9 is a diagram illustrating a stage circuit according to an alternative embodiment of the disclosure.

Referring to FIG. 9, an embodiment of a stage circuit STi' may include transistors T1 to T6, a capacitor C1, a first inverter INV1, and a second inverter INV2.

The second inverter INV2 may be coupled at an input terminal thereof to a scan line Si and coupled at an output terminal thereof to an inverted scan line SBi.

Since other components of the stage circuit STi' are substantially the same as those of the stage circuit STi of FIG. 3, any repeated detailed descriptions thereof will be omitted.

Figure 10:
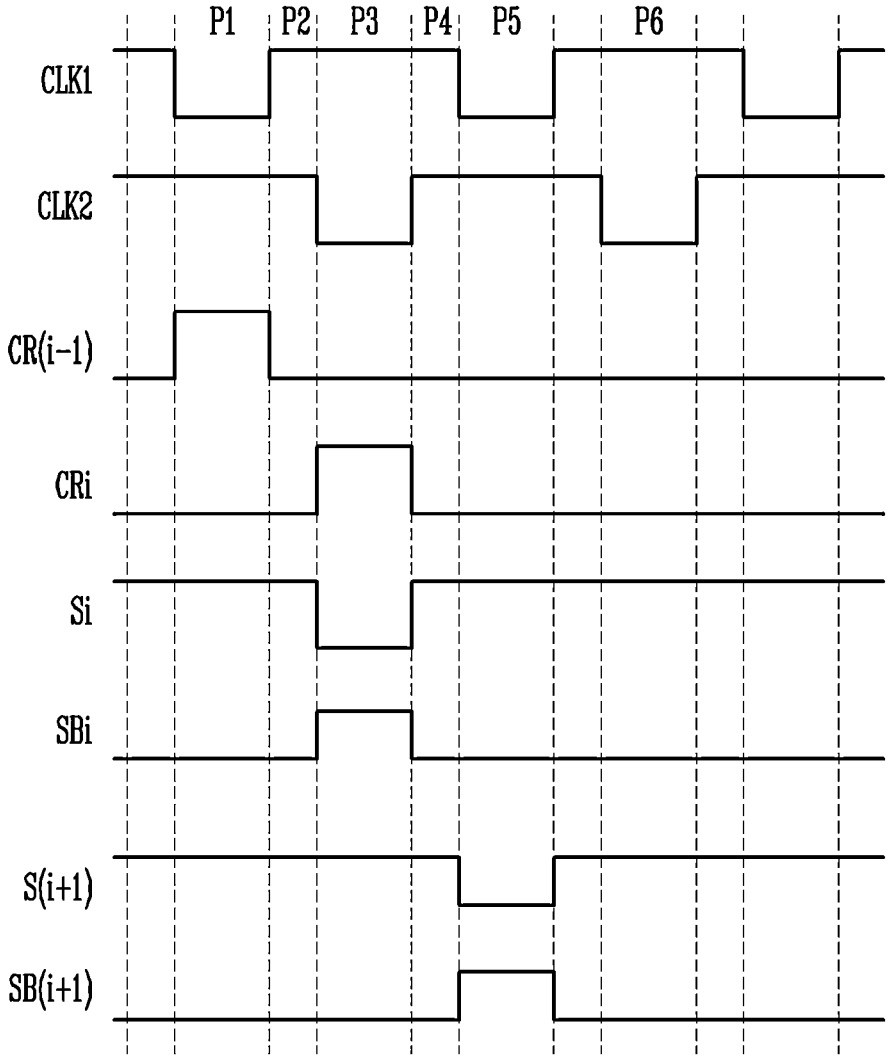
FIG. 10 is a diagram illustrating an embodiment of a method of driving the stage circuit of FIG. 9.

FIG. 10 is a diagram illustrating an embodiment of a method of driving the stage circuit of FIG. 9.

In FIG. 10, a first dock signal applied to a first dock signal line CLK1, a second dock signal applied to a second clock signal line CLK2, an input carry signal applied to an input carry line CR(i−1), an output carry signal applied to an output carry line CRi, a scan signal applied to a scan line Si, and an inverted scan signal applied to an inverted scan line SBi are illustrated. A next scan signal applied to a scan line S(i+1) and a next inverted scan signal applied to an inverted scan line SB(i+1) are illustrated for timing comparison.

Since the driving method of FIG. 10 is substantially the same as the driving method of FIG. 4, any repeated detailed descriptions thereof will be omitted.

Figure 11:
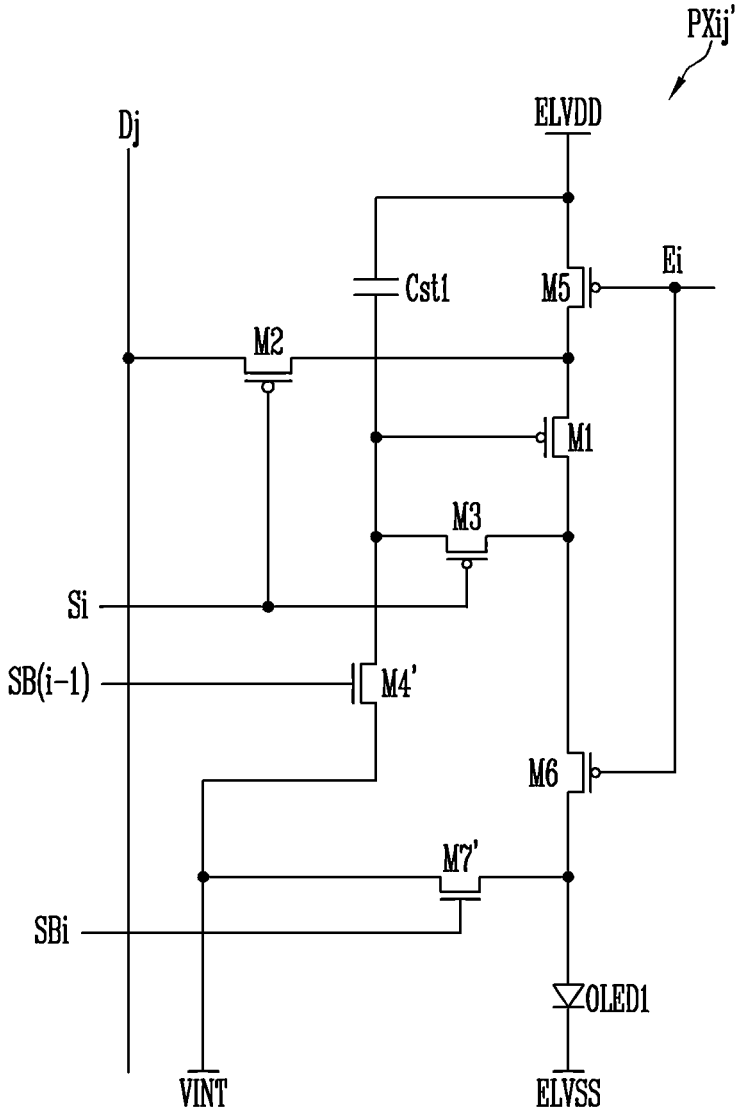
FIG. 11 is a diagram illustrating a pixel according to an alternative embodiment of the disclosure.
Figure 12:
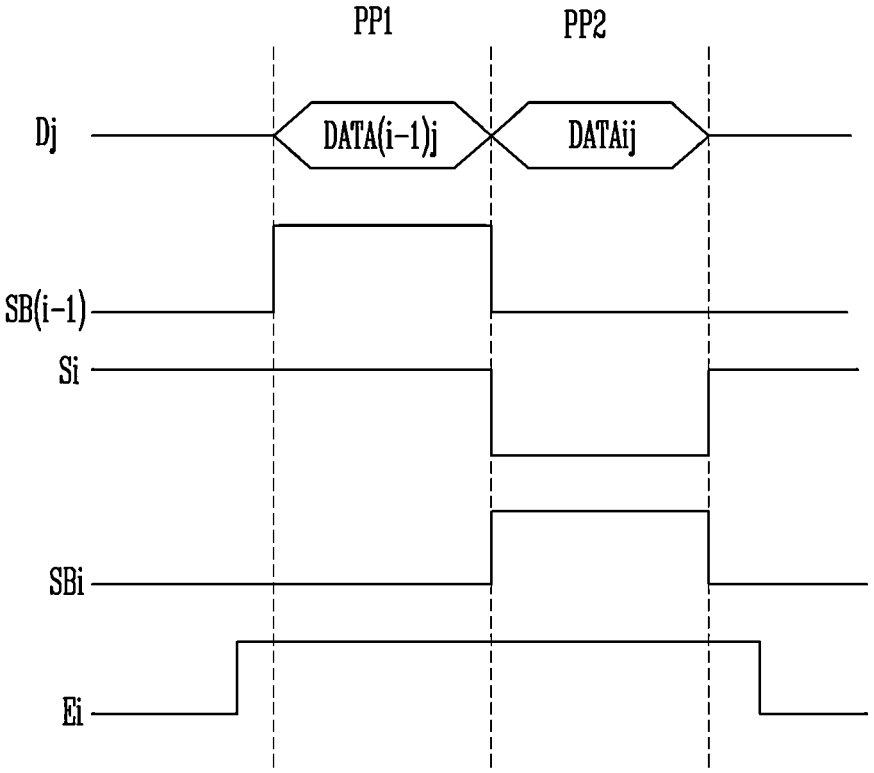
FIG. 12 is a diagram illustrating an embodiment of a method of driving the pixel of FIG. 11.

FIG. 11 is a diagram illustrating a pixel according to an alternative embodiment of the disclosure, and FIG. 12 is a diagram illustrating an embodiment of a method of driving the pixel of FIG. 11.

Referring to FIG. 11, an embodiment of a pixel PXij' includes transistors M1, M2, M3, M4', M5, M6, and M7', a storage capacitor Cst1 and an organic light-emitting diode OLED1.

In such an embodiment, the pixel PXij' has substantially the same configuration as the pixel PXij of FIG. 5 except for the transistors M4' and M7', and thus any repeated detailed descriptions of the same or like elements thereof will be omitted.

The transistor M4' may be implemented as an N-type transistor. A gate electrode of the transistor M4' may be coupled to an inverted scan line SB(i−1).

The transistor MT may be implemented as an N-type transistor. A gate electrode of the transistor M7' may be coupled to an inverted scan line SBi.

In one embodiment, for example, channels of the transistors M4' and M7' may include or be formed of an oxide semiconductor, and thus leakage current flowing into the initialization voltage line VINT may be minimized.

Referring to FIG. 12, turn-on times and turn-off times of the transistors M1, M2, M3, M4', M5, M5, and MT are substantially the same as those of the transistors M1, M2, M3, M4, M5, M6, and M7 shown in FIG. 5. Therefore, any repeated detailed descriptions thereof will be omitted here.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

The invention claimed is:

1. A scan driver, comprising:

stage circuits, wherein one of the stage circuits comprises:

a first transistor, wherein a first electrode thereof is directly coupled to a first node, a second electrode thereof is coupled to an input carry line which is an output carry line of a previous stage, and a gate electrode thereof is directly coupled to only a first clock line; and a capacitor, wherein a first electrode thereof is directly coupled to the first node and a second electrode thereof is directly coupled to a second node, wherein the second node is directly coupled to an output carry line which is an input carry line of a next stage, and wherein the second node is selectively coupled to one of a first power voltage line and a second power voltage line.

2. The scan driver according to claim 1, further comprising:

a second transistor, wherein a first electrode thereof is coupled to the second node, a second electrode thereof is coupled to the second power voltage line, and a gate electrode thereof is coupled to a second clock line.

3. The scan driver according to claim 2, further comprising:

a third transistor, wherein a first electrode thereof is coupled to the first power voltage line, a second electrode thereof is coupled to the second node, and a gate electrode thereof is coupled to a third node.

4. The scan driver according to claim 3, further comprising:

a fourth transistor, wherein a first electrode thereof is coupled to the second node, a second electrode thereof is coupled to the second power voltage line, and a gate electrode thereof is coupled to the third node.

5. The scan driver according to claim 4, further comprising:

a fifth transistor, wherein a first electrode thereof is coupled to the first power voltage line, a second electrode thereof is coupled to the third node, and a gate electrode thereof is coupled to the first node.

6. The scan driver according to claim 5, further comprising:

a sixth transistor, wherein a first electrode thereof is coupled to the third node, a second electrode thereof is coupled to the second clock line, and a gate electrode thereof is coupled to the first node.

7. The scan driver according to claim 6, wherein:

the first transistor, the third transistor, and the fifth transistor are P-type transistors, and the second transistor, the fourth transistor, and the sixth transistor are N-type transistors.

8. The scan driver according to claim 7, further comprising:

a first inverter, wherein an input terminal thereof is coupled to the second node and an output terminal thereof is coupled to a scan line.

9. The scan driver according to claim 8, further comprising:

a second inverter, wherein an input terminal thereof is coupled to the scan line and an output terminal thereof is coupled to an inverted scan line.

10. The scan driver according to claim 2, wherein pulses of a first clock signal applied to the first clock line do not temporally overlap pulses of a second clock signal applied to the second clock line.

* * * * *